US005468534A

United States Patent [19]

Godfrey et al.

[11] Patent Number: 5,468,534

[45] Date of Patent: Nov. 21, 1995

[54] ATTACHABLE DINNER NAPKIN

[76] Inventors: Ernest Godfrey; Edith Godfrey, both of 3334 Liverpool Point, Inverness, Fla. 34452

[21] Appl. No.: 292,219

[22] Filed: Aug. 19, 1994

[51] Int. Cl.[6] ..... B32B 3/06

[52] U.S. Cl. ..... 428/40; 428/99; 428/192; 428/194; 24/7

[58] Field of Search ..... 428/40, 99, 192, 428/194; 24/7; D6/595

[56] References Cited

FOREIGN PATENT DOCUMENTS 2054022 2/1981 United Kingdom ..... 24/7

*Primary Examiner*—Alexander S. Thomas

[57] ABSTRACT

A dinner napkin for releasably attaching to the clothing of a person to preclude movement of the napkin relative to the person. The inventive device includes a napkin having an adhesive attachment assembly coupled to an edge of the napkin. The adhesive attachment assembly includes a backing which can be removed to expose an adhesive cooperable with the person's clothing to retain the napkin relative thereto.

12 Claims, 3 Drawing Sheets

ATTACHABLE DINNER NAPKIN

BACKGROUND OF THE INVENTION

1. Field of the Invention

The present invention relates to napkin structures and more particularly pertains to an attachable dinner napkin for releasably attaching to the clothes of a person to preclude movement of the napkin relative to the person.

2. Description of the Prior Art

The use of napkin structures is known in the prior art. More specifically, napkin structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art napkin structures include U.S. Pat. No. 5,244,278; U.S. Pat. No. 5,187,813; U.S. Pat. No. 4,376,440; U.S. Pat. No. 4,337,772; and U.S. Pat. No. 3,673,060.

While these devices fulfill their respective, particular objectives and requirements, the aforementioned patents do not disclose an attachable dinner napkin for releasably attaching to the clothes of a person which includes a napkin having an adhesive attachment assembly coupled to an edge of the napkin, with the adhesive attachment assembly including a backing which can be removed to expose an adhesive cooperable with the persons clothing to retain the napkin relative thereto.

In these respects, the attachable dinner napkin according to the present invention substantially departs from the conventional concepts and designs of the prior art, and in so doing provides an apparatus primarily developed for the purpose of releasably attaching to the clothes of a person to preclude movement of the napkin relative to the person.

SUMMARY OF THE INVENTION

In view of the foregoing disadvantages inherent in the known types of napkin structures now present in the prior art, the present invention provides a new attachable dinner napkin construction wherein the same can be utilized for releasably attaching to the clothes of a person to preclude movement of the napkin relative to the person. As such, the general purpose of the present invention, which will be described subsequently in greater detail, is to provide a new attachable dinner napkin apparatus and method which has many of the advantages of the napkin structures mentioned heretofore and many novel features that result in a attachable dinner napkin which is not anticipated, rendered obvious, suggested, or even implied by any of the prior art napkin structures, either alone or in any combination thereof.

To attain this, the present invention generally comprises a dinner napkin for releasably attaching to the clothing of a person to preclude movement of the napkin relative to the person. The inventive device includes a napkin having an adhesive attachment assembly coupled to an edge of the napkin. The adhesive attachment assembly includes a backing which can be removed to expose an adhesive cooperable with the person's clothing to retain the napkin relative thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new attachable dinner napkin apparatus and method which has many of the advantages of the napkin structures mentioned heretofore and many novel features that result in a attachable dinner napkin which is not anticipated, rendered obvious, suggested, or even implied by any of the prior art napkin structures, either alone or in any combination thereof.

It is another object of the present invention to provide a new attachable dinner napkin which may be easily and efficiently manufactured and marketed.

It is a further object of the present invention to provide a new attachable dinner napkin which is of a durable and reliable construction.

An even further object of the present invention is to provide a new attachable dinner napkin which is susceptible of a low cost of manufacture with regard to both materials and labor, and which accordingly is then susceptible of low prices of sale to the consuming public, thereby making such attachable dinner napkins economically available to the buying public.

Still yet another object of the present invention is to provide a new attachable dinner napkin which provides in the apparatuses and methods of the prior art some of the advantages thereof, while simultaneously overcoming some of the disadvantages normally associated therewith.

Still another object of the present invention is to provide a new attachable dinner napkin for releasably attaching to the clothes of a person to preclude movement of the napkin relative to the person.

Yet another object of the present invention is to provide a new attachable dinner napkin which includes a napkin having an adhesive attachment assembly coupled to an edge of the napkin, with the adhesive attachment assembly including a backing which can be removed to expose an adhesive cooperable with the persons clothing to retain the napkin relative thereto.

Even still another object of the present invention is to provide a new attachable dinner napkin including a storing and dispensing means for releasably containing a plurality of such napkins.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
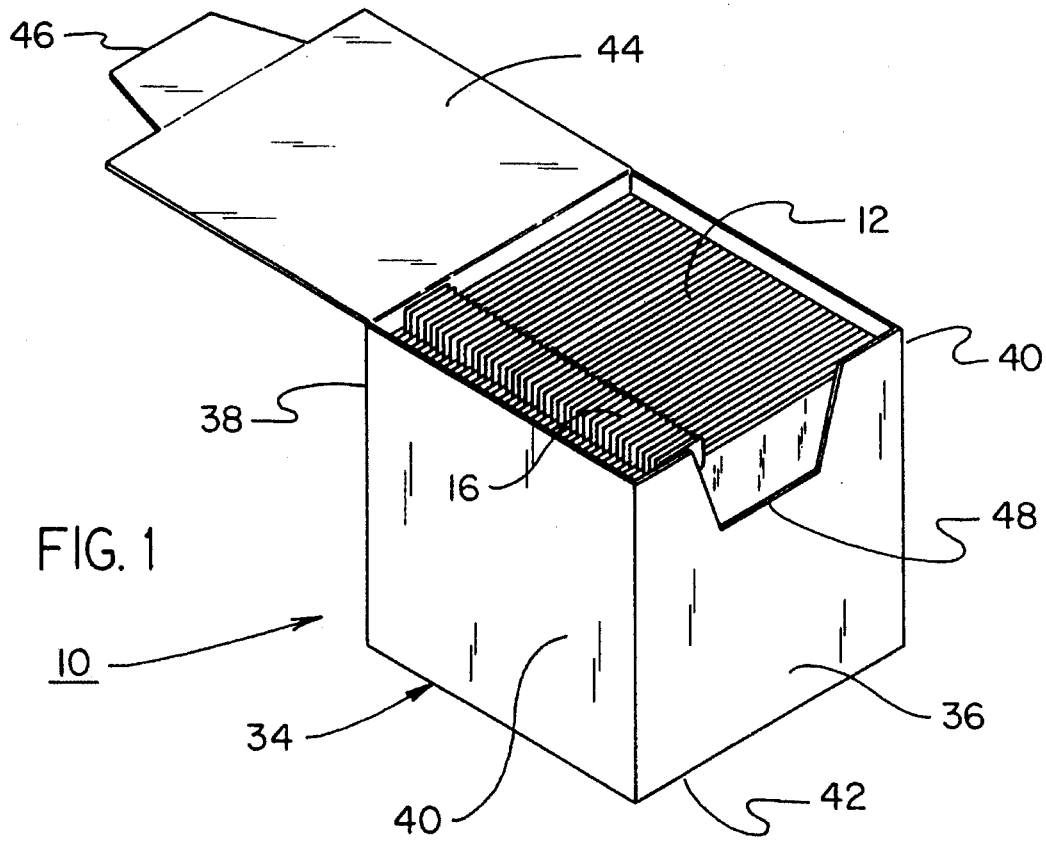
FIG. 1 is an isometric illustration of a plurality of attachable dinner napkins according to the present invention and contained within a storing and dispensing means.
Figure 2:
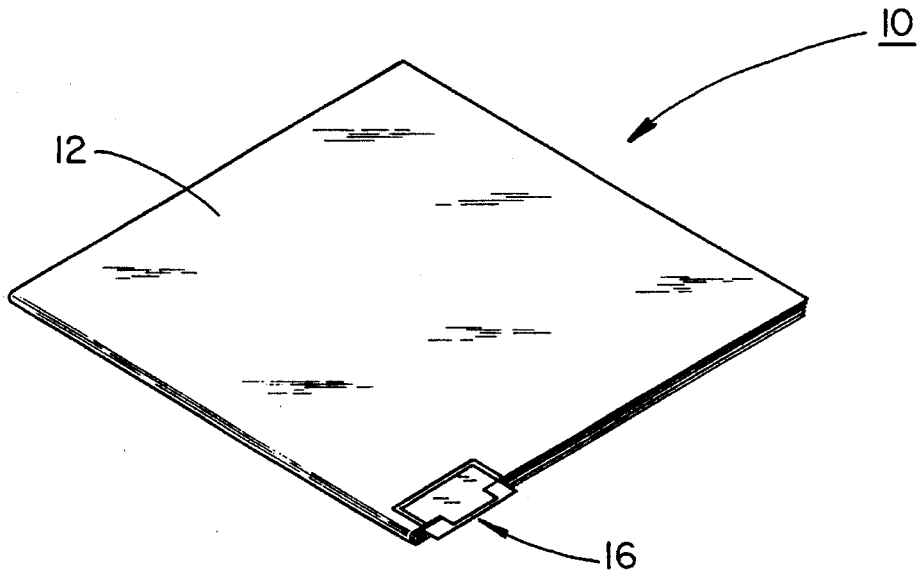
FIG. 2 is an isometric illustration of the napkin, per se, in a folded configuration.

With reference now to the drawings, and in particular to FIGS. 1–6 thereof, a new attachable dinner napkin embodying the principles and concepts of the present invention and generally designated by the reference numeral 10 will be described.

Figure 3:
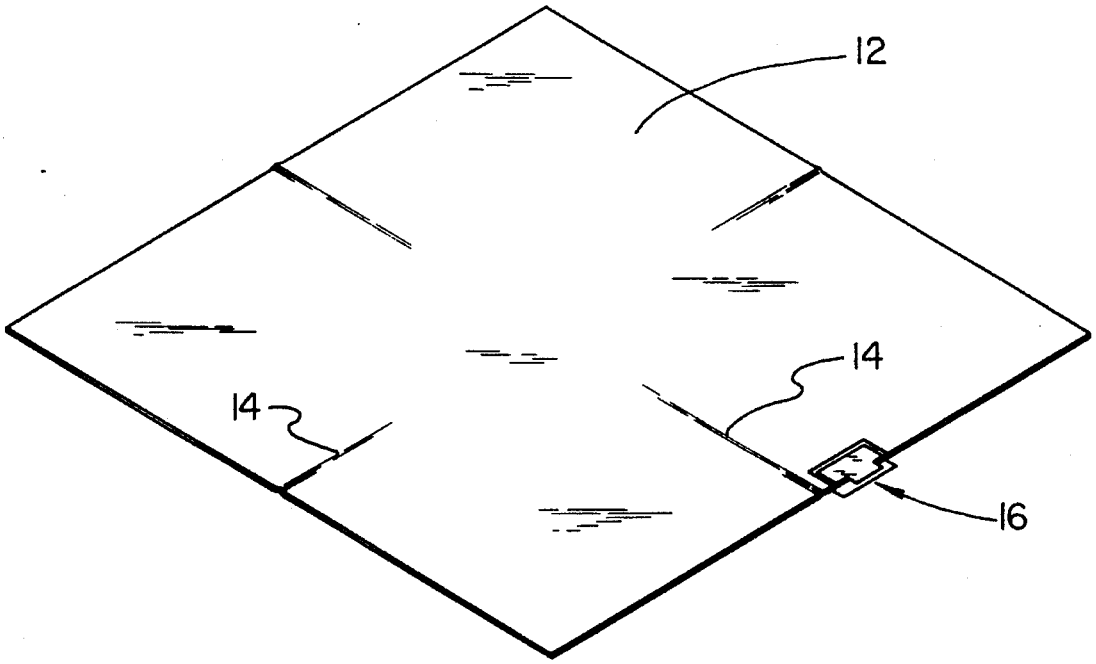
FIG. 3 is a further isometric illustration of the napkin in an unfolded configuration.

More specifically, it will be noted that the attachable dinner napkin 10 comprises a preferably substantially square napkin 12 formed of an absorbent material, such as cotton, linen, or paper pulp which may be utilized for cleaning purposes during the course of a meal. The napkin 12 may be of any desired shape, but is preferably substantially square in shape and includes a pair of orthogonally oriented fold lines 14 extending through a center thereof, as illustrated in FIG. 3, which permit the napkin 12 to be folded into the compact configuration illustrated in FIG. 2. By this structure, the napkin 12 may be unfolded and positioned across the lap or other area of an individual during a dining procedure, whereby crumbs and the like are captured thereon.

Figure 4:
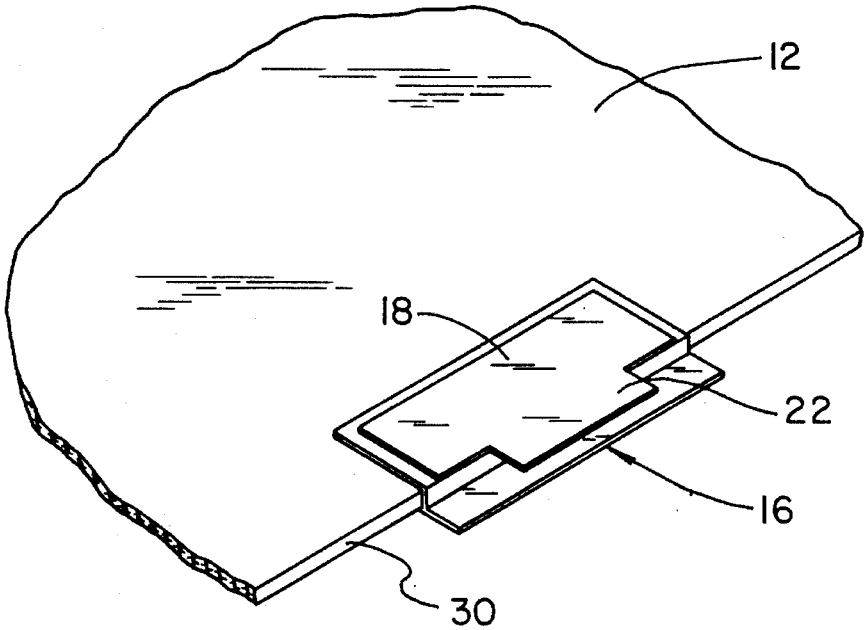
FIG. 4 is an enlarged isometric illustration of a portion of the present invention.
Figure 5:
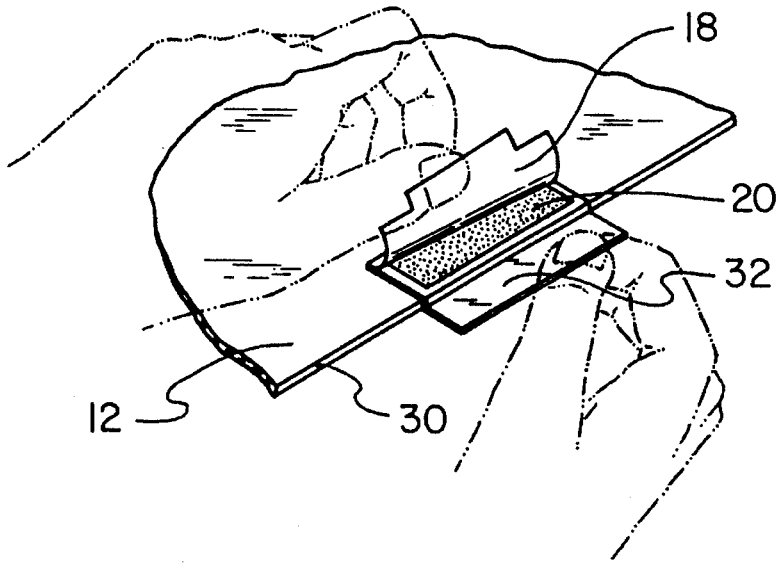
FIG. 5 is a further isometric illustration teaching removal of the backing of the adhesive attaching means.
Figure 6:
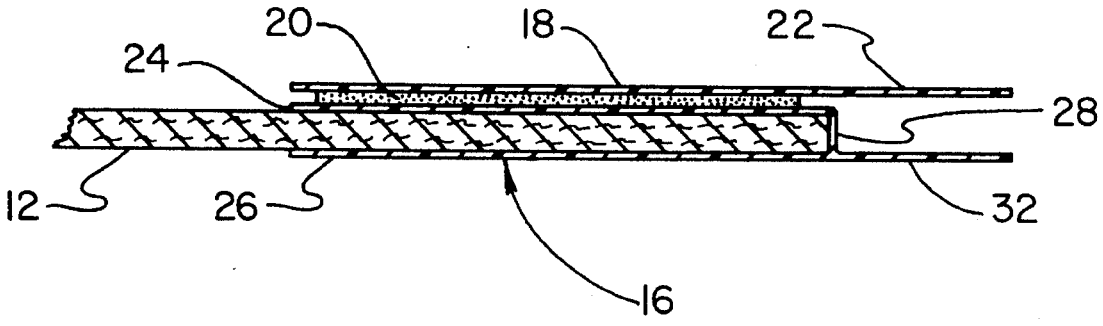
FIG. 6 is a cross sectional view of the adhesive attaching means.

Referring now to FIGS. 4 through 6, it can be shown that the attachable dinner napkin 10 further comprises an adhesive attaching means 16 for securing the napkin 12 to the clothing of an individual. To this end, the adhesive attaching means 16 includes a removable backing 18 which can be peeled away from the remainder of the adhesive attaching means 16 to expose an adhesive 20 positioned therebeneath. Removal of the backing 18 is facilitated by a backing pull tap 22 which extends outwardly from the main portion of the backing.

Referring now to FIG. 6, it can be shown that the adhesive attaching means 16 more specifically comprises an upper plate 24 spaced from a lower plate 26 with an edge joiner 28 extending between the upper and lower plates. The edge joiner 28 is of a height approximately equal to the thickness of the napkin 12 such that the edge joiner may be positioned into abutting relationship with the edge 30 of the napkin. Further, a napkin handle 32 comprising an extension of the lower plate 26 projects from an intersection of the edge joiner 28 and the lower plate 26 beyond the edge 30 of the napkin 12. The napkin handle 32 is operable to be grasped and manipulated by an individual during both removal of the backing 18 and application of the adhesive attaching means 16 to the individuals clothing. The upper and lower plates 24, 26, as well as the edge joiner 28 may be joined to the napkin 12 by a further adhesive placed upon the napkin and into contact with the interior surfaces of the upper and lower plates. Alternatively, the upper and lower plates 24, 26, as well as the edge joiner 28, may be formed of a substantially ductile metallic material, whereby a crimping of the plates together will mechanically fasten the adhesive attaching means 16 to the edge 30 of the napkin 12.

Turning now to FIG. 1, it can be shown that the present invention 10 may additionally comprise a storing and dispensing means 34 for releasably containing a plurality of the napkins 12 and associated adhesive attaching means 16. To this end, the storing and dispensing means 34 comprises a substantially rectangular container having a front wall 36 spaced from a rear wall 38 with opposed side walls 40 extending orthogonally between the laterally opposed edges of both the front and rear walls. Further, the container includes a bottom wall 42 secured across bottom or lower edges of the front and rear walls 36, 38 and to the side walls 40. A pivotal top wall 44 is hingedly coupled to an upper edge of the rear wall 38 at a first edge of the pivotal top wall such that the top wall may be selectively pivoted to effect closure of the container. A trapezoidal extension 46 extends from a second opposed edge of the pivotal top wall 44 and is operable to be received within a trapezoidal cut-out 48 of substantially similar configuration formed along an upper edge of the front wall 36. The trapezoidal cut-out 48 is operable to permit ease of access to the napkins 12 contained within the storing and dispensing means 34. By this structure, a plurality of such napkins 12 can be packaged, shipped, shelved, and sold together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An attachable dinner napkin comprising:

a napkin formed of an absorbent material;

an adhesive attaching means for securing the napkin to clothing of an individual, said adhesive attaching means comprising an upper plate spaced from a lower plate with an edge joiner extending between said upper and lower plates, said edge joiner being of a height approximately equal to a thickness of said napkin with said edge joiner being positioned into abutting relationship with an edge of said napkin, means to secure said upper and lower plates to said napkin, said means to secure said upper and lower plates to said napkin comprising a further adhesive coupling said napkin to said plates, said adhesive attaching means further comprising a napkin handle, said napkin handle comprising an extension of said lower plate which projects from an intersection of said edge joiner and said lower plate beyond said edge of the napkin, and an adhesive coupled to said upper plate.

2. The attachable dinner napkin of claim 1, wherein said adhesive attaching means further includes a removable backing which can be peeled away from said adhesive attaching means to expose said adhesive positioned therebeneath.

3. The attachable dinner napkin of claim 2, wherein said backing comprises a pull-tab extending beyond said edge of said napkin.

4. The attachable dinner napkin of claim 3, wherein said napkin is square in shape and includes a pair of orthogonally oriented fold lines extending through a center thereof which permit said napkin to be folded.

5. The attachable dinner napkin of claim 4, and further comprising a storing and dispensing means for releasably containing a plurality of said napkins.

6. The attachable dinner napkin of claim 5, wherein said storing and dispensing means comprises a substantially rectangular container having a front wall spaced from a rear wall, with opposed side walls extending orthogonally between laterally opposed edges of both said front and rear walls; a bottom wall secured across lower edges of said front and rear walls and said side walls; a pivotal top wall hingedly coupled at a first edge thereof to an upper edge of said rear wall, said pivotal top wall having a trapezoidal extension extending from a second opposed edge of said pivotal top wall, said front wall having a trapezoidal cut-out, wherein said trapezoidal extension is operable to be received within said trapezoidal cut-out when said top wall is in a closed configuration.

7. The attachable dinner napkin of claim 1, wherein said adhesive attaching means further comprises a napkin handle, said napkin handle comprising an extension of said lower plate which projects from an intersection of said edge joiner and said lower plate beyond said edge of the napkin.

8. The attachable dinner napkin of claim 7, wherein said adhesive attaching means further includes a removable backing which can be peeled away from said adhesive attaching means to expose said adhesive positioned therebeneath.

9. The attachable dinner napkin of claim 8, wherein said backing comprises a pull-tab extending beyond said edge of said napkin.

10. The attachable dinner napkin of claim 9, wherein said napkin is square in shape and includes a pair of orthogonally oriented fold lines extending through a center thereof which permit said napkin to be folded.

11. The attachable dinner napkin of claim 10, and further comprising a storing and dispensing means for releasably containing a plurality of said napkins.

12. The attachable dinner napkin of claim 11, wherein said storing and dispensing means comprises a substantially rectangular container having a front wall spaced from a rear wall, with opposed side walls extending orthogonally between laterally opposed edges of both said front and rear walls; a bottom wall secured across lower edges of said front and rear walls and said side walls; a pivotal top wall hingedly coupled at a first edge thereof to an upper edge of said rear wall, said pivotal top wall having a trapezoidal extension extending from a second opposed edge of said pivotal top wall, said front wall having a trapezoidal cut-out, wherein said trapezoidal extension is operable to be received within said trapezoidal cut-out when said top wall is in a closed configuration.

* * * * *